US006748844B2

(12) United States Patent
Ang

(10) Patent No.: US 6,748,844 B2
(45) Date of Patent: Jun. 15, 2004

(54) ARTILLERY FIRING SYSTEM

(75) Inventor: Teoh Hwa Ang, Singapore (SG)

(73) Assignee: Ordnance Development and Engineering Company of Singapore (1996) Pte LTD, Singapore (SG)

( * ) Notice: Subject to any disclaimer, the term of this patent is extended or adjusted under 35 U.S.C. 154(b) by 0 days.

(21) Appl. No.: 10/259,668

(22) Filed: Sep. 27, 2002

(65) Prior Publication Data

US 2004/0055451 A1 Mar. 25, 2004

Related U.S. Application Data

(62) Division of application No. 09/734,800, filed on Dec. 12, 2000, now abandoned.

(30) Foreign Application Priority Data

Dec. 29, 1999 (SG) ..... 9906572-4

(51) Int. Cl.[7] ..... F41F 1/06

(52) U.S. Cl. ..... 89/37.05; 89/37.07; 89/37.13; 89/37.14; 89/42.01; 89/14.3

(58) Field of Search ..... 89/37.05, 37.07, 89/37.13, 37.14, 40.06, 40.09, 40.01, 42.01, 14.3

(56) References Cited

U.S. PATENT DOCUMENTS

| | | | | | |
|---|---|---|---|---|---|
| 410,968 | A | | 9/1889 | Canet | 89/40.02 |
| 422,203 | A | | 2/1890 | Anderson | 89/40.02 |
| 566,138 | A | * | 8/1896 | Cochrane | |
| 1,671,281 | A | * | 5/1928 | Gorton | |
| 1,810,654 | A | * | 6/1931 | Haubroe | |
| 2,413,703 | A | | 1/1947 | Fischer | 89/1 |
| 2,444,334 | A | | 6/1948 | Caulkins | 89/37.05 |
| 2,599,565 | A | | 6/1952 | Lontz | 89/40.02 |
| 2,790,357 | A | * | 4/1957 | Garrett | |
| 3,171,325 | A | * | 3/1965 | Vickers | |
| 3,892,163 | A | | 7/1975 | Asikainen | 89/37.05 |
| 3,969,982 | A | | 7/1976 | Pier-Amory et al. | 89/178 |
| 4,436,017 | A | * | 3/1984 | Mohlin | 89/14.3 |
| 6,024,007 | A | | 2/2000 | Searle et al. | 89/43.01 |

FOREIGN PATENT DOCUMENTS

| | | | | |
|---|---|---|---|---|
| DE | 310019 | * | 1/1918 | 89/37.05 |
| DE | 300702 | | 11/1920 | |
| EP | 0140053 | | 5/1985 | |
| FR | 601830 | | 3/1926 | |
| FR | 2674949 | | 10/1992 | |
| GB | 100016 | * | 1/1916 | 89/37.05 |
| GB | 115013 | * | 4/1918 | 89/40.06 |

OTHER PUBLICATIONS

Merriam Webster; 1985; pp. 912 and 1220.*

* cited by examiner

*Primary Examiner*—Stephen M. Johnson
(74) *Attorney, Agent, or Firm*—Ladas & Parry

(57) ABSTRACT

A recoil buffering apparatus for use with an artillery gun of the type comprising a breech assembly (15) connected to a barrel (12), the breech assembly (15) having a firing mechanism for firing a projectile through an open end of the barrel (12). The recoil buffering apparatus comprises a recoil buffering means adapted to be fixed to the barrel (12) and movable therewith during recoil action of the barrel (12) caused by firing of the projectile, and a support means associated with the recoil buffering means for supporting the recoil buffering means and thereby supporting the barrel (12) and breech assembly (15) through the recoil buffering means. An elevating apparatus and a traversing apparatus for an artillery gun are also described. The artillery gun can also be provided with a muzzle brake (11).

9 Claims, 6 Drawing Sheets

ARTILLERY FIRING SYSTEM

This application is a divisional of application Ser. No. 09/734,800 filed on Dec. 12, 2000, now abandoned, claims the benefit thereof and incorporates the same by reference.

FIELD OF INVENTION

This invention relates to a platform or vehicle-mounted artillery firing system and in particular to a platform or vehicle-mounted mortar system and improvements in relation thereto.

BACKGROUND AND PRIOR ART

Traditionally, a mortar system was an infantry and commando weapon that was designed for man-packing. It had to be broken down into a few sub-assemblies to resolve the weight constraint necessitated by man-packing. Therefore, to set up the mortar system for firing will take at least a few minutes. However, mortar systems have now been mounted on various vehicles to meet the quick response required in performing hit-and-run missions demanded in modern warfare.

The traditional mortar system consists of a barrel and breech assembly, bipod assembly and a base-plate. The breech piece has a spherical joint with the base-plate sitting on the ground. The bipod assembly is used for supporting the barrel and for fine adjustment of its elevation and travel. The gas pressure acting on the breech and the reaction force generated during firing, which are subsequently transmitted onto the structure (base-plate) is very high. It could be as high as 150,000 kPa, but it is not a problem for a solid structure such as a base-plate that sits on the ground and acts as a natural damper.

When the mortar system is platform-mounted (in particular when it is mounted on a vehicle), most system integrators currently use the traditional mortar system and focus on designing the structure to withstand the firing force. This will result in heavy structural reinforcement/modification of the mounting platform (vehicle). The damping adapter has been developed by some system integrators as an interface between the mortar and the platform (vehicle) which is able to reduce the firing force to about 40%. However, even with a 60% reduction (60,000 kPa) of the firing force, it is still very large and requires a heavy structure to withstand it. The suspension system also requires reinforcement if the platform (vehicle) is designed to fire on it.

The following problems have been borne in mind when solving the deficiencies, such as lack of recoil buffering and accuracy of the mortar systems of the prior art, and the lack of manoeuverability of the whole vehicle.

Recoil Mechanism

The recoil buffer mechanism is the most essential part of the gun system. The traditional mortar system is designed for man-packing and therefore its weight must be relatively lighter to allow portability. Thus the recoil mechanism has never been considered for use in the mortar system. However, when the mortar system is platform-mounted (vehicle-mounted), the recoil forces become more critical compared to the weight of the individual sub-assembly. Hence, some system integrators have incorporated the recoil mechanism to absorb the high recoil force, but this mechanism may not be efficient as the recoiling mass is too low to absorb the firing energy effectively and subsequently convert it to the recoil braking force.

Cradle Design of Conventional Gun Systems

"O"-cradle designs, "U"-cradle designs and a combination of both are the three most common cradle designs in gun systems that are used for the support and guidance of the recoiling mass during firing.

The "O" cradle design is the first-generation gun cradle design. It has two bushes at both ends of the cradle to support and allow the barrel to slide on its outer cylindrical surface when recoiling during firing. It is the simplest in construction and the most commonly-used design. The big and long cylindrical sliding surface on the barrel carries an excessive amount of weight. On the other hand, there are minimum number of parts attached on the recoiling mass, which reduces the effectiveness of the buffering of the recoil.

The "U" cradle design is the second-generation gun cradle design. The "T" shaped slot on the cradle is used to support and guide the barrel while recoiling during firing. Two brackets are attached onto the barrel (or one on the barrel and one on the breech) as a bridge between the barrel and cradle. The external profile of the barrel can be optimized to achieve the design strength (gas pressure distance profile). Hence, there will be significant weight reduction on the barrel. The recoil cylinder can be attached together with the barrel to increase the recoiling mass to reduce the recoiling force. However, the cradle is complex in both design and manufacturing.

The "O" and "U" combination cradle design takes advantage of the benefits of both the above designs. Its front support is an "O" cradle design and its rear side is a "T" cradle design. The cylindrical surface of the barrel on its centre portion is used for front sliding and only one bracket is attached onto either the barrel or on the breech as the rear support. The barrel external profile is very close to an optimized design and it saves one bracket. The cradle is, however, complex in both design and manufacturing. Regardless of all the three types of cradle design, the minimum length of the cradle will be two×support length+recoiling length+safety allowance.

Muzzle Brake

To-date, the muzzle brake has not been adopted onto any mortar system. The traditional mortar system is designed to be man-packed. Its weight is very critical. Therefore, the muzzle brake has never been considered for the mortar system.

The bomb muzzle velocity is very much slower than the gas flow when it leaves the barrel. The bomb will be unstable because of gas turbulence at the muzzle. Trying to re-stabilize the flight path of the bomb during flight will result in the bomb losing its kinetic energy and accuracy.

Elevating and Traversing Mechanism

The most common elevating mechanisms used in gun design are the arc and pinion gear design, the single actuator at the centre, or two actuators installed on both sides of the elevating mass in parallel. The base width of these mechanisms is quite small.

The arc and pinion gear or linear actuator are most commonly used for the traversing mechanism. In the arc and pinion mechanism, backlash (clearances) in the gear trains is essential to ensure the smooth running of the mechanism. The acceptable backlash in the traversing mechanism for accurate gun laying demand high precision and costly components. Alternatively, complex anti-backlash mechanisms are normally employed to resolve the problem. Another disadvantage is that the gear teeth have friction due to their relative movements and are prone to wear and tear since it is very difficult to protect against dust and dirt in its operating environment. The uneven wear and tear will cause malfunction of the anti-backlash mechanism after prolonged usage.

The linear actuator is only used in traverse mechanisms having a smaller arc of traverse. Furthermore, it has a non-linear (cosine error) correlation movement between the linear actuator and the rotating action. This will complicate the control system for a closed-loop power drive system.

The invention herein seeks to overcome most of the disadvantages in the prior art mentioned above.

SUMMARY OF THE INVENTION

An objective of the invention is to provide a tetrahedron shape for the arrangement of the elevating cylinder avoids causing each member to suffer excessive bending force and the stable shape allows the barrel to move in one plane or in one direction. Therefore, the improved system can be mounted on a much lower class of platform or vehicle (eg. from a 30-tonne vehicle to a 10-tonne vehicle).

According to one aspect of the invention there is provided an elevating apparatus for an artillery gun of the type comprising a breech assembly connected to a barrel, the breech assembly having a firing mechanism for firing a projectile through an open end of the barrel, the elevating apparatus comprising a support means adapted to support the barrel and breech assembly and three connecting members, the support means including three support members two of which include an elevating mechanism for raising and lowering the barrel wherein the three connecting members are disposed in a substantially triangular arrangement, and the three connecting members and the three support members are disposed in a substantially tetrahedral arrangement.

Preferably there are two of said piston and cylinder combinations.

Preferably each said elevating mechanism includes a piston and cylinder combination which is arranged such that relative movement between the piston and cylinder causes the barrel to be raised or lowered. Preferably there are two of said piston and cylinder combinations.

The support means preferably includes a cradle adapted to support the barrel directly or indirectly, wherein at least one of the support members is secured at one end to the cradle and at the other end to a support platform. The piston and cylinder combinations may be secured to the cradle so that it can provide support for the barrel and the breech assembly.

A respective one of said connecting member is desirably connected between the support platform and each of the two said pistons and cylinder combinations, and a third one of the connecting members is a cross-connecting member is desirably connected between said two piston and cylinders.

According to another aspect of the invention there is provided a traversing apparatus for an artillery gun comprising a breech assembly connected to a barrel, the breech assembly having a firing mechanism for firing a projectile through an open end of the barrel, the traversing apparatus comprising; a support platform which is adapted to support the barrel and breech assembly in such a manner that said barrel and breech assembly may rotate relative to the support platform in order to impart a traversing motion to the barrel and breach assembly, the support platform including an arcuate guide member having support means adapted to support the barrel and breech assembly so that the support means follows the guide member during said traversing motion of the barrel and breech assembly; and drive means secured to the support means and adapted to drive movement of the support means along the guide member to cause said traversing motion, wherein the drive means comprises a drive wheel and a drive cable wrapped around the drive means or in connection therewith, the drive cable being substantially fixed relative to the guide member so that rotation of the drive wheel causes the drive wheel and the support means to be driven along the guide member.

The drive cable preferably sits in a recess provided in the drive wheel. The recess in the drive wheel preferably extends around the drive wheel in a substantially helical fashion. The drive cable may extend at least partly around the guide member. It is desirable that tensioning means is provided to maintain the drive cable in tension.

The support means may include at least one support member adapted to support the barrel and the breech assembly. Preferably, the or each support member includes a mechanism for adjusting the elevation of the barrel. Most preferably there are two support members.

In a preferred embodiment, the guide member is provided with a T-shaped recess, and the support means is provided with a formation adapted to engage the recess thereby guiding movement of the support means along the guide member.

According to another aspect of the invention there is provided an elevating apparatus for an artillery gun of the type comprising a breech assembly connected to a barrel, the breech assembly having a firing mechanism for firing a projectile through an open end of the barrel, the elevating apparatus comprising three base members disposed in a substantially triangular arrangement, and three support members arranged to support the artillery gun, wherein at least one of the support members is extendible to vary the elevation of the artillery gun, and wherein the base members and the support members are disposed in a substantially tetrahedral arrangement.

Preferably, two of the support members are extendible. Preferably also, the or each extendible support member comprises a piston and cylinder arrangement.

The elevating apparatus according to this aspect of the invention may also be provided with features of the elevating apparatus described above.

According to another aspect of the invention there is provided an artillery gun comprising a breech assembly connected to a barrel, the breech assembly having a firing mechanism for firing a projectile through an open end of the barrel, wherein the barrel includes a muzzle brake through which projectile propellant gas can escape from the barrel.

According to another aspect of the invention there is provided an artillery gun comprising an elevating apparatus, a recoil buffering apparatus, and a breech assembly connected to a barrel. The breech assembly having a firing mechanism for firing a projectile through an open end of the barrel, and the recoil buffering apparatus comprising a recoil buffering means adapted to be integrated or other wise secured to the barrel and movable therewith during recoil action of the barrel caused by firing of the projectile, and support means associated with the recoil buffering means for supporting the recoil buffering means and thereby supporting the barrel and breech assembly through the recoil buffering means.

The artillery gun according to the invention is preferably platform or vehicle mounted.

As used herein the expression "artillery gun" means guns, cannons, howitzers, mortars and the like, which have a calibre of at least 40 mm, preferably above 50 mm.

BRIEF DESCRIPTION OF THE DRAWINGS

The drawings illustrates the preferred embodiment of the invention relating to its use in a mortar system.

DETAILED DESCRIPTION OF THE PREFERRED EMBODIMENT OF THE INVENTION

Figure 1A:
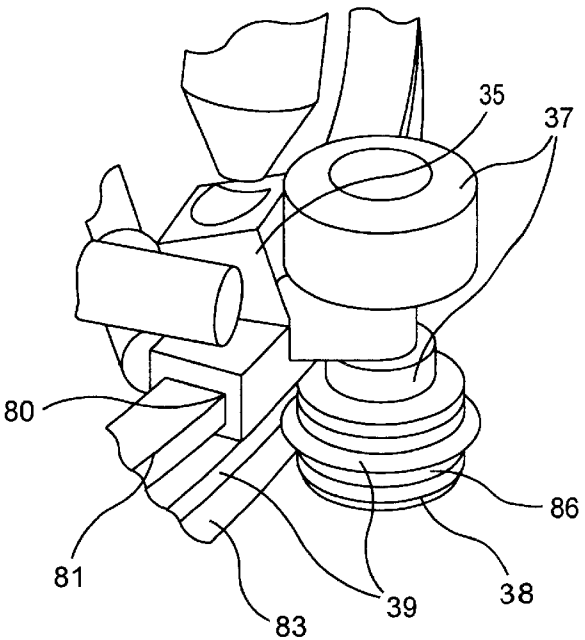
FIG. 1A is a partial view of FIG. 1.
Figure 1:
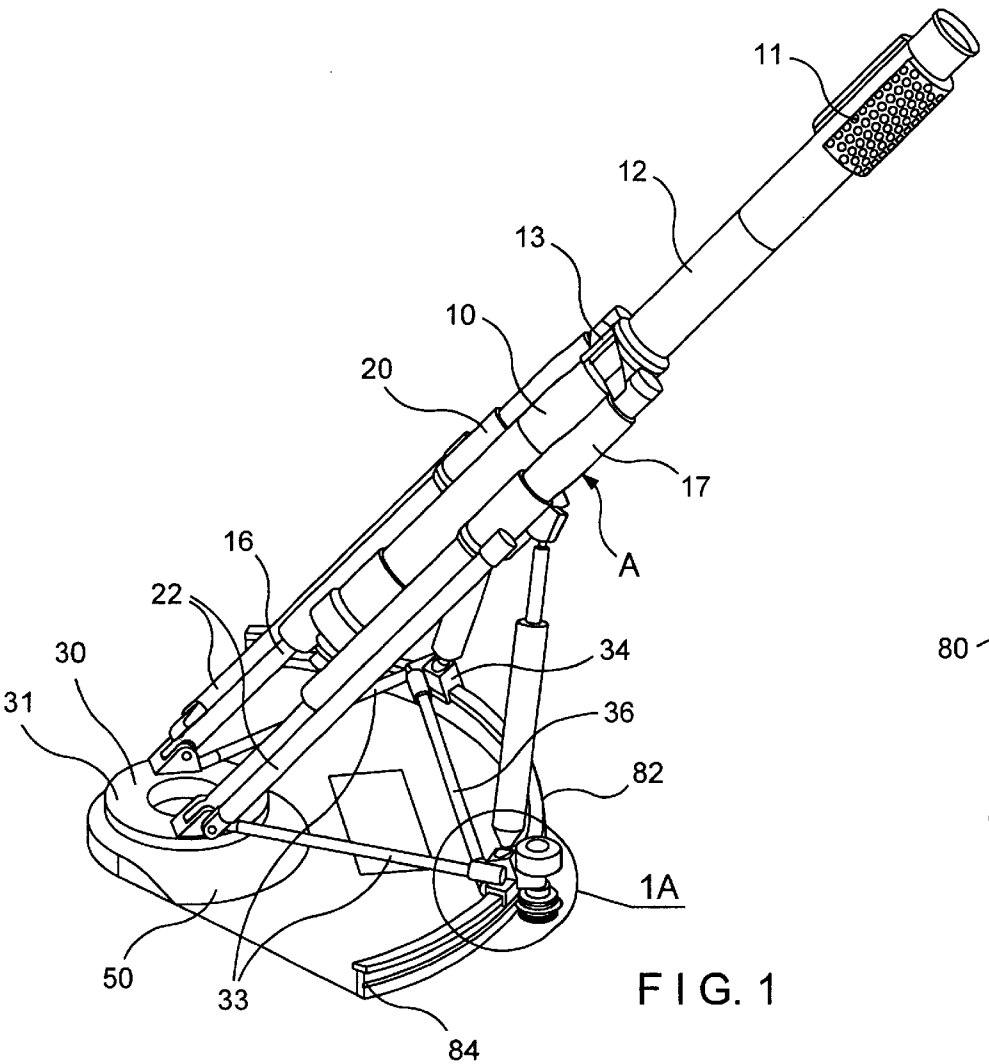
FIG. 1 is an isometric view of the mortar system together with an enlarged view of the traversing mechanism.
Figure 2:
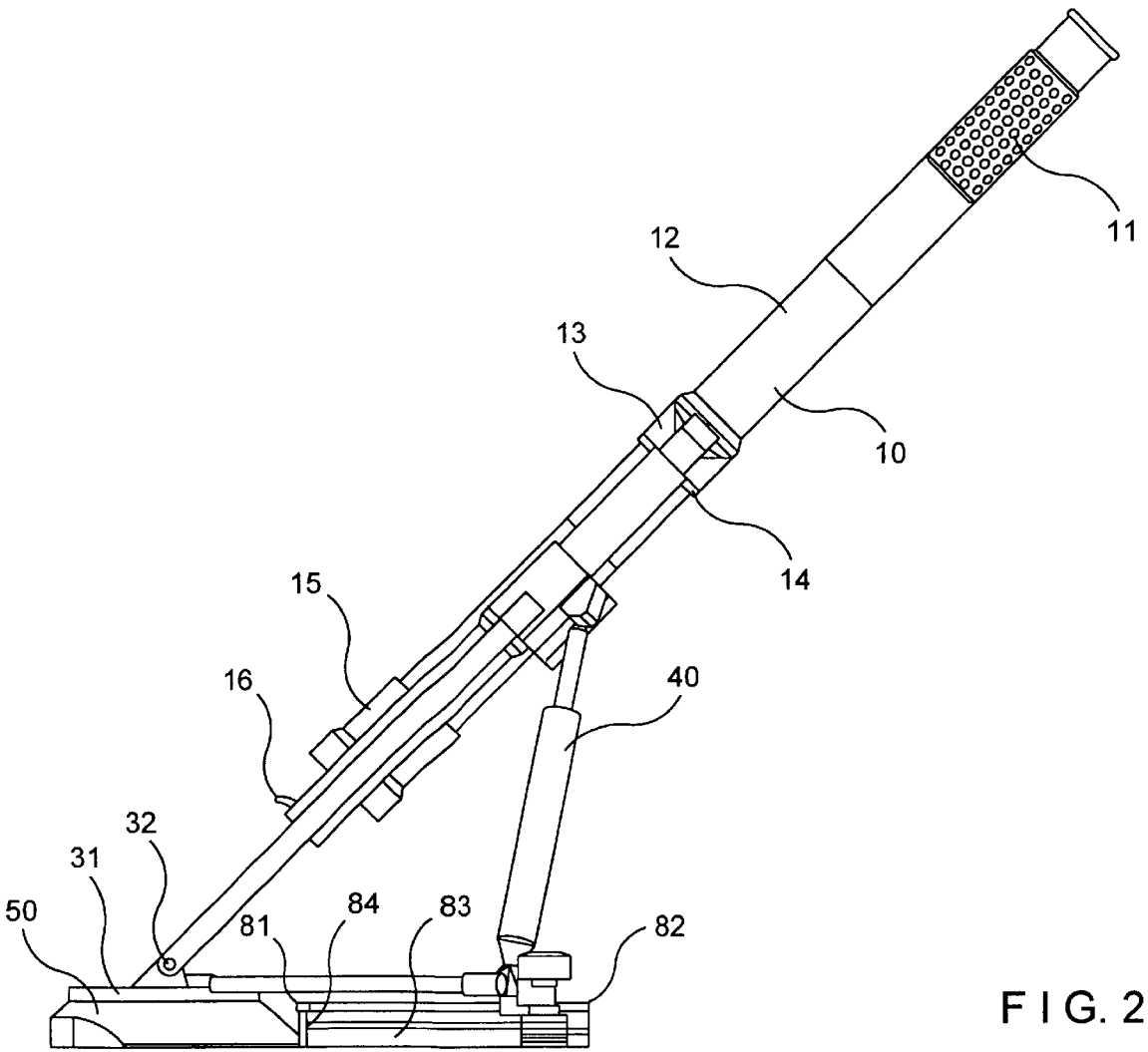
FIG. 2 is a side view of the mortar system illustrated in FIG. 1.
Figure 3:
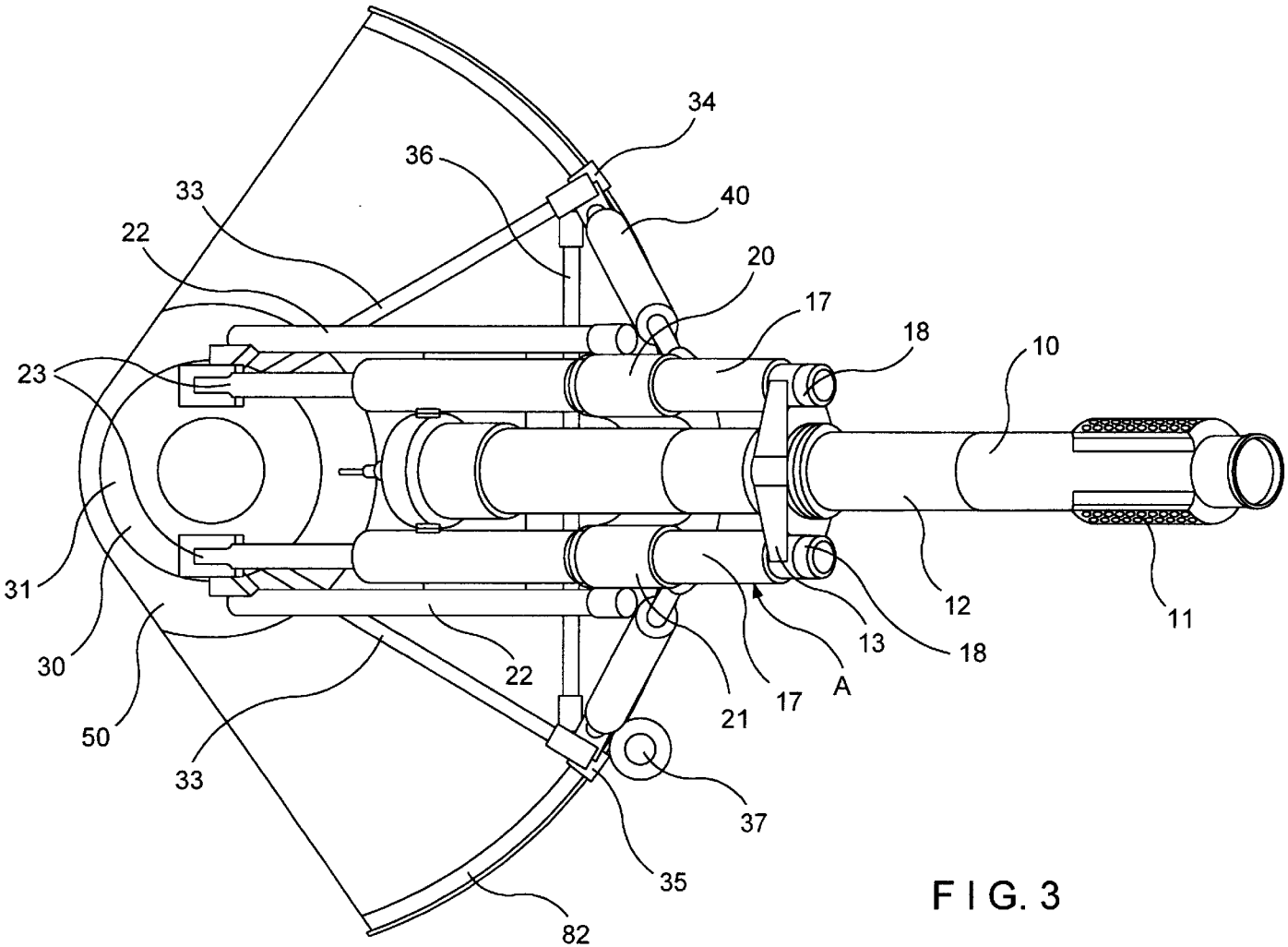
FIG. 3 is a plan view of the mortar system illustrated in FIG. 1.
Figure 4:
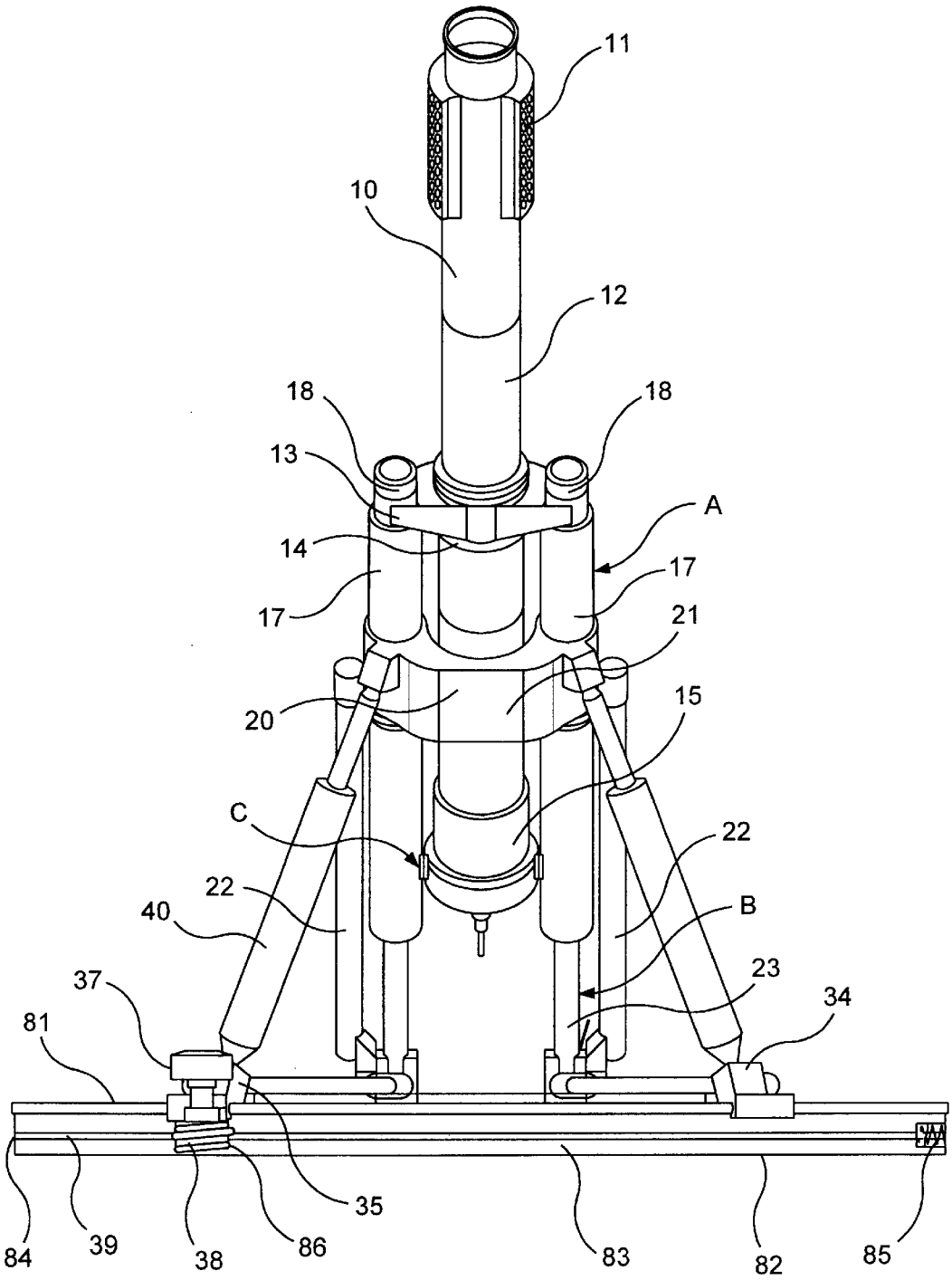
FIG. 4 is a front view of the mortar system illustrated in FIG. 1.

FIG. 1 is an isometric view of the mortar system according to the preferred embodiment of this invention. FIG. 1 should be read with FIGS. 2, 3 and 4 which illustrate the side, plan and front views of the mortar system respectively. The mortar system consists of the recoiling mass 10, elevating mass 20, traversing mass 30 and track assembly 50.

Recoiling Mass

The recoiling mass 10 consists of a muzzle brake 11, barrel 12, breech 15, yoke 13, recoil buffer cylinder 17 and lock nuts.

A muzzle brake 11 with a pepper-port design is located at the front end of the barrel. It could either be integrated into the barrel 12 (mono-block) or detachable for ease of production. The breech 15 with the firing mechanism (not shown) and firing lever 16 are attached at the other end of the barrel to form the chamber for firing. The barrel 12 is supported by the yoke 13 and is secured by the lock-nut yoke 14.

The two recoil buffer cylinders 17 are attached to the yoke 13 and fastened to it by the lock-nut recoil buffer 18. The recoil buffer piston rods 23 are pivoted to the trunnion 32 on the saddle 31. The guiding surface (C) on the outer surface of the recoil buffer cylinders 17 will guide the barrel 10 and ensure that the recoil buffer cylinders and barrel are parallel. During the recoiling motion, the whole recoiling mass 10 is sliding relative to the cradle 21 on the outer surface (A) of the recoil buffer cylinders 17 and outer surface (B) of the recoil buffer piston rods 23.

The recoil buffer has a hydra-pneumatic type design, in that the buffer and recuperating functions are integrated. It is optimized for the particular recoiling mass 10 for firing the maximum charge of the particular bomb. It is designed to convert the impulsive force that is generated by the gas pressure to kinetic energy and subsequently to discharge it as a braking force evenly throughout the whole length of the recoiling stroke. The recoiling mass 10 will be pushed back to its original position after the kinetic energy has been completely discharged by the energy stored in the recoil buffer cylinders 17.

The invention significantly simplifies the cradle design and reduces the recoiling force by maximizing the recoil mass 10. The invention simplifies the cradle design by using the recoil sliding surface (A) of the recoil buffer cylinder 17 and the piston rods 23 that serve as supports and guides for the whole recoiling mass. The length of the cradle 21 is very much shortened (it has only one support length) and it is supported on the outer surface of the recoil buffer cylinder 17 instead of the two supporting points on the barrel, so that the cradle does not experience any recoiling force. The two recoil buffer cylinders 17 are mounted together with the barrel 12.

During firing, the gas pressure generated in the barrel 12 that acts on the breech end will be transformed to kinetic energy by accelerating the recoiling mass. The braking force will be generated by the recoil buffering action and transmitted to the two recoil buffer cylinders 17 through the yoke 13. The two recoil buffer cylinders 17 are parallel with the barrel and recoil buffer piston rods 23 are pivoted to the trunnion 32 on the saddle 31 directly. The invention reduces the recoil forces by attaching the two recoil buffer cylinders 17 together with the barrel 12 to maximize the recoiling mass and reducing the weight of the cradle by anchoring the piston rods 23 of the recoil buffer cylinder 17 to the saddle 31 directly. Therefore, the recoil force is directed to the saddle 31 and the cradle 21 will not suffer from any recoil force. Hence, the function of the cradle 21 will only be to support and guide the recoiling mass 10, and the structural strength of the cradle can be substantially reduced.

Muzzle Brake

The mortar system incorporates a muzzle brake 11 onto the barrel of the artillery gun to reduce the recoiling force and blast (overpressure at the gun crew area). It also increases the range and improves the accuracy of the bomb.

Figure 5:
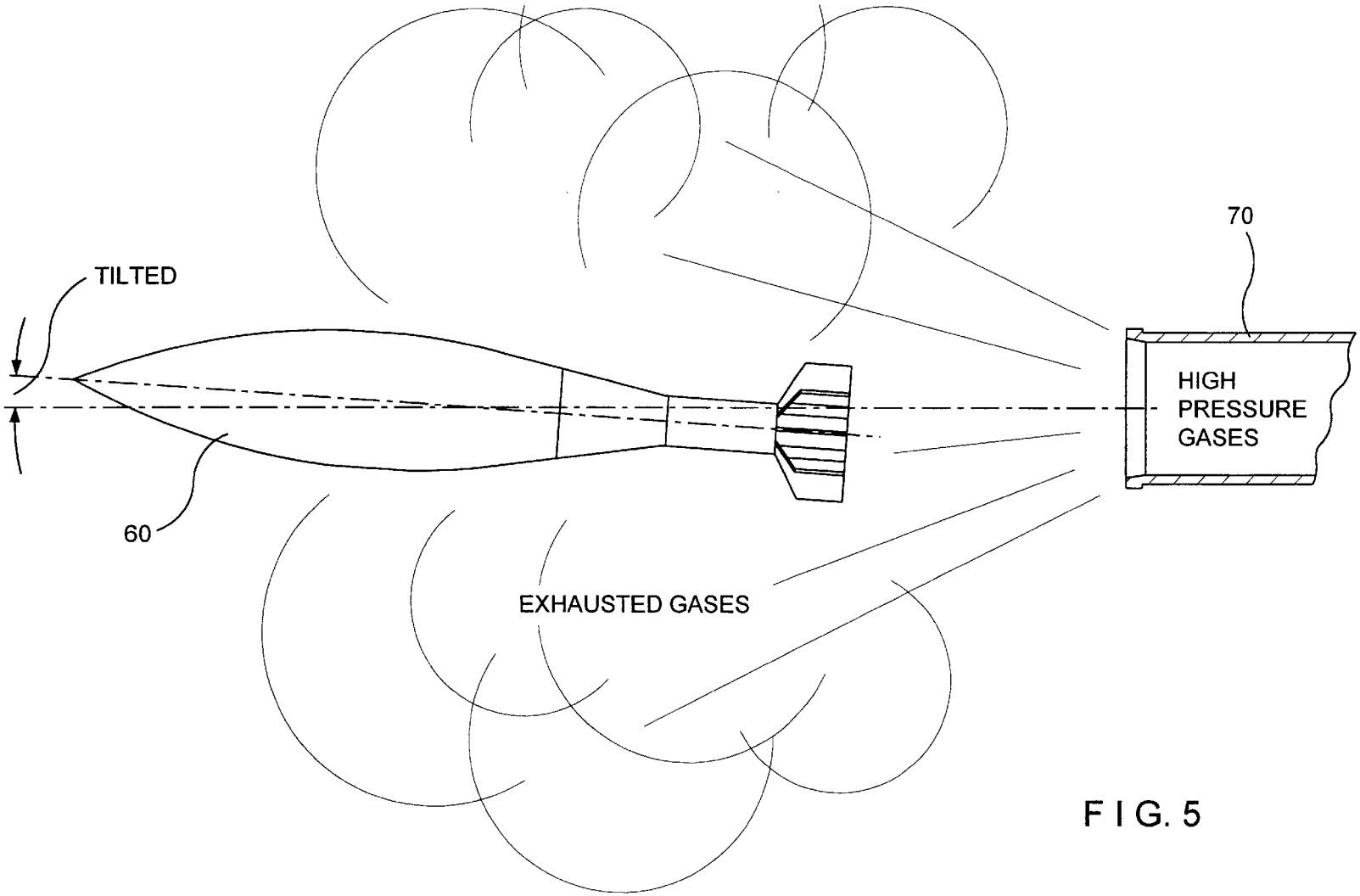
FIG. 5 is a side view of a mortar bomb leaving the barrel of a conventional mortar gun illustrating the effect of muzzle disturbance on the mortar bomb.

FIG. 5 is a side view of a mortar bomb 60 leaving the barrel 70 of a conventional mortar gun illustrating the effect of muzzle disturbance on the mortar bomb 60. There is muzzle disturbance because the propellant gases escape through the opening of the barrel 70 as the bomb 60 leaves the opening of the barrel 70. The tilting of the bomb 60 caused by the disturbance is quite significant. As a result of the muzzle disturbance, the accuracy of the bomb is much reduced.

Figure 6:
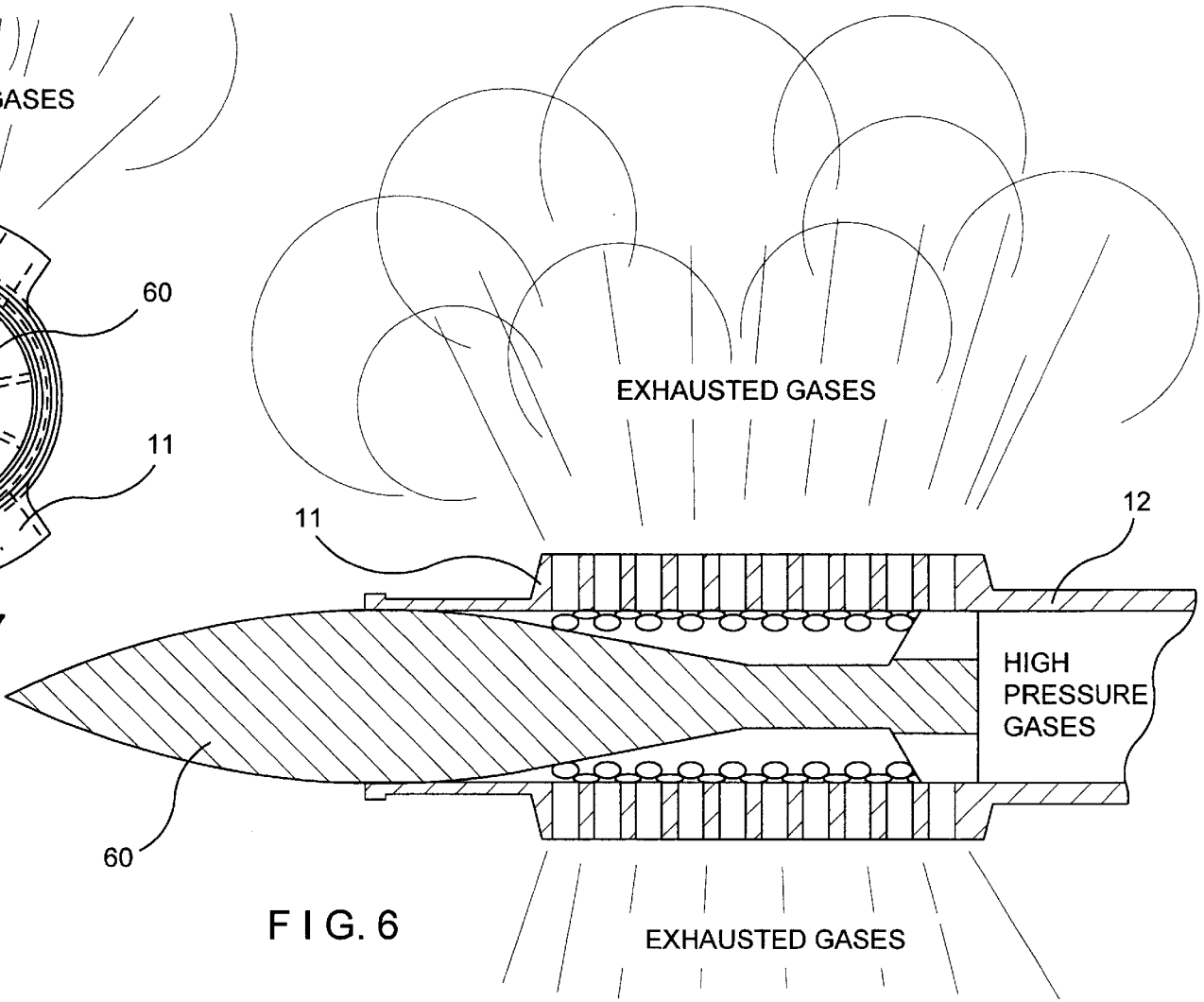
FIG. 6 illustrates a mortar bomb leaving the barrel of a mortar gun fitted with a muzzle brake according to the present invention.
Figure 7:
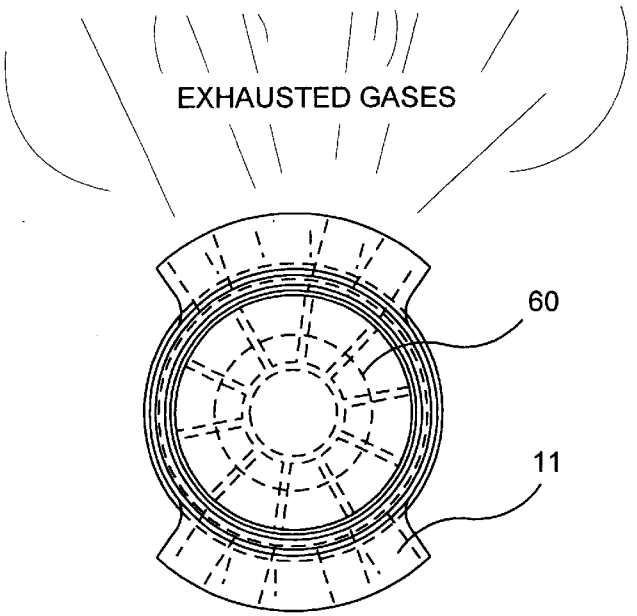
FIG. 7 shows an end view of the muzzle brake according to the present invention

FIG. 6 illustrates a mortar bomb 60 leaving the barrel 12 of a mortar gun fitted with a muzzle brake 11 according to the present invention. The muzzle brake 11 includes plurality of portholes to allow the gases to escape from the barrel 12 through the portholes instead of through the mouth of the barrel 12. The invention allows significant amount of gases to escape through the portholes before the bomb leaves the barrel muzzle. Therefore, the gas pressure at the muzzle when the bomb 60 leaves the barrel 12 will be significantly reduced, thereby reducing muzzle disturbance. Consequently, the bomb 60 will reach steady-flight very much earlier, which will increase the range and improve the accuracy of the bomb 60.

The invention also reduces blast (overpressure at the gun crew area) as the release of the high-pressure gases has been spread over a longer period of time. It further reduces the recoiling force because of the muzzle brake efficiency. The change in direction of the high-pressure gas flow that acts on the muzzle brake 11 will reduce the recoil force, unlike in the conventional mortar system without the muzzle brake.

Elevating Mass

The elevating mass 20 consists of the cradle 21 and the whole of the recoiling mass 10.

The cradle 21 is designed to support and guide the whole recoiling mass 10 on the outer surface A of the two recoil buffer cylinders 17. The cradle 21 is connected by the cradle connecting tube 22 and pivoted at the trunnion 32 on the saddle 31. The bottom of the cradle 21 is connected to the elevating cylinders 40 to vary the elevation of the whole elevating mass 20.

Elevating Mechanism

FIGS. 1 to 4 also illustrate the design of the elevating and traversing mechanism. The cradle 21 of the mortar system is mounted on two elevating cylinders 40. Two saddle connecting tubes 33 and a cross-connecting tube 36 form a base triangle. The cradle connecting tubes 22, saddle connecting tubes 33 and elevating cylinders 40 form two side triangles. The elevating cylinders 40 are sited on the left front support 34 and right front support 35 and both are connected to the cradle 21 for varying the elevation of the whole elevating mass 20. The elevating mechanism of the two elevating cylinders 40 could be hydraulic or mechanical screw types. However, regardless of either type of design, the two elevating cylinders 40 have to be linked for synchronous movement.

The two elevating cylinders 40 and the cross-connecting tube 36 form a front triangle. The four triangles mentioned forms a tetrahedron shape. This is the most stable geometry since the base width of the mechanism has been significantly increased. This geometry also eliminates any bending moment that acts on the structural members. Hence, the structural strength and weight of the elevating mass design is substantially reduced. The invention thus reduces the number of moving joints of the whole elevating mechanism and also simplifies the design.

Traversing Mass

The traversing mass 30 consists of a saddle 31, two connecting tubes 33, left front support 34, right front support 35 with traversing gear housing 37, cross connecting tube 36, two elevating cylinders 40 and the whole of the elevating mass 20.

The saddle 31 is sited in the centre of the track assembly 50 and is rotatable. The left front support 34 and the right front support 35 have "T"-shaped recesses or slots (80). Both front supports 34, 35 ride on the "T"-shaped formation (81) of the arcuate guide member or track (82) of the support platform or track assembly 50 which is concentric with the centre and allows both front support 34, 35 to slide on it. The saddle 31 and front supports 34, 35 are all connected by two saddle connecting tubes 33 and cross-connecting tube 36 to form a triangular base.

The elevating cylinder 40 is sited on the left front support 34 and right front support 35 and both front supports 34, 35 are connected to the cradle 21 to vary the elevation of the whole elevating mass 20.

Traversing Mechanism

The traversing mechanism consists of the three base connecting tubes 33, 36 connecting the left front support 34, right front support 35 and the saddle 31. The saddle 31 is sited in the centre of the track assembly 50 and is rotatable around a vertical axis. The left front support 34 and the right front support 35 have "T" shaped recesses or slots (80). They ride on the "T"-shaped formation (81) of the arcuate guide member or track (82) of the support platform or track assembly 50 which is concentric with the centre and allows the left front support 34 and the right front support 35 to slide on it. Since the saddle 31 and front supports 34 & 35 are connected by two saddle connecting tubes 33 and cross-connecting tube 36 to form a triangular base, the assembly allows the traversing mass 30 to rotate along the track assembly 50 to permit lateral traverse of the structure.

The invention differs from the convention arc and pinion as the gear teeth are replaced with a steel drive cable 39. The steel drive cable 39 rests on the plain cylindrical surface (83) of the track assembly 50 with one end (84) fixed. The drive cable 39 wraps around the drive wheel or pinion 38 while the other end is tensioned by a spring (85). The steel cable 39 sits in the semi-circular spiral or helical, recess or groove (86) on the pinion 38. The pinion 38 holds its position firmly as it is squeezed by the tension in the steel cable 39. The semi-circular spiral groove (86) on the pinion increases the contact surface between the steel cable 39 and the pinion 38. It also improves the gripping power and prevents deformation of the steel cable.

The traversing gear housing 37 is attached to the right front support 35 as an integrated block. It houses the bearings, which support the pinion 38. The pinion's driving mechanism could be a worm and worm gear, which is a very common design, and can be manual or power driven.

The traversing movement is generated when the pinion 38 is rotated in similar fashion to a gear's arc and pinion action. The rotating action of the pinion 38 winds the steel cable 39 from one side as well as concurrently unwinding it on the opposite side. Therefore, a differential tension in the steel cable 39 will be generated and will subsequently move the traversing mass 30.

Unlike the gear teeth in a conventional arc and pinion design, the invention does not have a relative movement in between the steel cable 39 and the pinion 38. Therefore, there is zero backlash in the traversing mechanism. In addition, dust and dirt trapped in the steel cable and the pinion will not affect its functionality. The invention also eliminates the problem of malfunctioning in extreme temperatures caused by the thermal expansion of the material in the conventional arc and pinion design as whatever changes in the size of material caused by a change in temperature will be automatically compensated by the tension in the steel cable spring (not shown). Therefore, it becomes an environmentally full-proof system.

The invention is also very much simplified, lighter in weight and significantly allows larger tolerance in the production of the components.

The invention described herein is susceptible to variations, modifications and/or additions other than those specifically described and it is to be understood that the invention includes all such variations, modifications and/or additions which fall within the spirit and scope of the above description. Although the preferred embodiment of the invention mentioned above relates to a mortar firing system, the invention may also be suitable for other types of artillery systems.

What is claimed is:

1. In an elevating apparatus for an artillery gun having a breech assembly (15) connected to a barrel (12), the breech assembly (15) having a firing mechanism for firing a projectile through an open end of the barrel (12), the improvements of an elevating apparatus comprising a support means for supporting the barrel (12) and breech assembly (15), and three connecting members (33, 36), the support means including three support members (22, 40) two of which include respective elevating mechanisms for raising and lowering the barrel (12), wherein the three connecting members (33, 36) are disposed in a substantially triangular arrangement and the three connecting members (33, 36) and the three support members (22, 40) are disposed in a substantially tetrahedral arrangement.

2. An artillery gun according to claim 1, and further comprising a recoil buffering apparatus having a recoil buffering means adapted to be integrated or otherwise secured to the barrel (12) and movable therewith during recoil action of the barrel (12) caused by the firing of the projectile (60), wherein the support means is associated with the recoil buffering means for supporting the recoil buffering means and, thereby, the supporting of the barrel (12) and breech assembly (15).

3. An artillery gun according to claim 2, wherein the artillery gun is a mortar gun, and wherein the barrel (12) includes a muzzle brake (11) through which projectile propellant gas can escape from the barrel (12).

4. Apparatus according to claim 1, wherein the elevating mechanisms include at least one piston and cylinder combination for the raising and lowering of the barrel (12).

5. Apparatus according to claims 4, wherein the support means includes a cradle (21 ) adapted to support the barrel (12) directly or indirectly, wherein at least one of the support members (22, 40) is secured at one end to the cradle (21) and at the other end to a support platform, and wherein the piston and cylinder combination is secured to the cradle (21) for the supporting of the barrel (12) and the breech assembly (15).

6. Apparatus according to claim 4, wherein the support means includes a cradle (21) adapted to support the barrel (12) directly or indirectly, wherein at least one of the support members (22) is secured at one end to the cradle (21) and at the other end to a support platform (31), wherein there are two of the piston and cylinder combination secured to the cradle (21) for the supporting of the barrel (12) and the breech assembly (15), and wherein two of the three connecting members (33) are respectively connected between the support platform (31) and the two piston and cylinder combinations, and a third one of the connecting members (36) is a cross-connecting member connected between the two piston and cylinder combinations.

7. In an elevating apparatus for an artillery gun having a breech assembly (15) connected to a barrel (12), the breech assembly (15) having a firing mechanism for firing a projectile through an open end of the barrel (12), the improvements of an elevating apparatus comprising three connecting members (33, 36) disposed in a substantially triangular arrangement, and three support members (22, 40) arranged to support the artillery gun, wherein at least two of the support members (40) are extendible to vary the elevation of the artillery gun, and wherein the connecting members (33, 36) and the support members (22, 40) are disposed in a substantially tetrahedral arrangement.

8. An elevating apparatus according to claim 7, wherein each of the extendible support members comprises a piston and cylinder arrangement.

9. An artillery gun according to claim 7, and further comprising a recoil buffering apparatus having a recoil buffering means adapted to be integrated or otherwise secured to the barrel (12) and movable therewith during recoil action of the barrel (12) caused by the firing of the projectile (60), wherein the support members are associated with the recoil buffering means for supporting the recoil buffering means and, thereby, the supporting of the barrel (12) and breech assembly (15).

* * * * *